US006205308B1

(12) United States Patent
Tanaka et al.

(10) Patent No.: US 6,205,308 B1
(45) Date of Patent: Mar. 20, 2001

(54) ELECTROPHOTOGRAPHIC PHOTOSENSITIVE MEMBER WITH SOUND ABSORBING MEMBER

(75) Inventors: Yasushi Tanaka; Akira Terasawa, both of Nagano (JP)

(73) Assignee: Fuji Electric Imaging Device Co., Ltd., Nagano (JP)

( * ) Notice: Subject to any disclaimer, the term of this patent is extended or adjusted under 35 U.S.C. 154(b) by 0 days.

(21) Appl. No.: 09/561,908

(22) Filed: May 1, 2000

(30) Foreign Application Priority Data

May 11, 1999 (JP) ..... 11-129897

(51) Int. Cl.[7] ..... G03G 15/00
(52) U.S. Cl. ..... 399/159
(58) Field of Search ..... 399/116, 159, 399/176, 279, 357, 117; 492/18, 42

(56) References Cited

U.S. PATENT DOCUMENTS 5,722,016 * 2/1998 Godlove et al. ..... 399/159
5,960,236 * 9/1999 Zaman et al. ..... 399/91
6,075,955 * 6/2000 Cais et al. ..... 399/91

FOREIGN PATENT DOCUMENTS 61-056379 * 3/1986 (JP) .
62-229273 * 10/1987 (JP) .

* cited by examiner

*Primary Examiner*—Robert Beatty
(74) *Attorney, Agent, or Firm*—Kanesaka & Takeuchi

(57) ABSTRACT

An electrophotographic photosensitive member is formed of a photosensitive drum, and a cylindrical resin member having a metallic spring therein. The cylindrical resin member is situated inside the photosensitive drum to provide a pressure to an inner surface of the drum. The electrophotographic photosensitive member has a charging-sound absorption capability, wherein the cylindrical resin member is not adversely affected when it is left in an adverse environment.

3 Claims, 2 Drawing Sheets

ELECTROPHOTOGRAPHIC PHOTOSENSITIVE MEMBER WITH SOUND ABSORBING MEMBER

BACKGROUND OF THE INVENTION AND RELATED ART STATEMENT

The present invention relates to a cylindrical electrophotographic photosensitive member.

In a conventional charging process for electrophotographic image-forming apparatuses, a contact-based charging apparatus has been widely used. In the contact-based charging apparatus, a charging member with a high voltage applied thereto is directly contacted with a surface of an electrophotographic photosensitive member to charge a photosensitive layer of the photosensitive member. In this case, the charging member is comprised of rollers or brushes.

Advantages of the contact method relative to the corona discharge method, which had been commonly used before the contact method has become popular, include a substantially reduced amount of ozone generation and a relatively simple and compact design for the structure of the apparatus.

One problem of the contact charging method is noise occurring during the charging operation. In general, in applying a voltage to the charging member, in the contact charging method, an appropriate alternating voltage is superposed on an underlying direct voltage to improve uniformity of charging on the surface of the photosensitive member. This alternating component may be the cause of charging-related noise, as it induces vibration between the charging member and the photosensitive member, with vibration levels varying with the applied alternating frequency (Japanese Patent Application Laid Open No. 4-86682). This noise depends on the condition of the apparatus, and is perceived as a relatively high sound by a person. This sound is very uncomfortable in a normal office environment, and should desirably be reduced to a level at which it no longer induces unpleasant effect on an office environment.

In a conventional well-known method effective for reducing the charging sound, a sound-absorbing member is placed inside the photosensitive drum (Japanese Patent Applications Laid Open No. 5-35166, No. 5-35167, No. 5-35048 and No. 8-54804).

FIG. 6 is a perspective view of a conventional cylindrical member made from resin. In this figure, the cylindrical resin member has a slit therein extending in an axial direction thereof, and the resin has a spring function so that the cylindrical member can be fixed inside the photosensitive drum in pressure contact therewith (Japanese Patent Application Laid Open No. 8-54804).

Although the above method with the cylindrical resin member is generally excellent in terms of its function, operability and economy, this cylindrical member is adversely affected when it is left in the environment, that is, it may lose its sound reduction effect depending on environmental conditions.

This problem arises from the stress constantly effected inside the photosensitive drum on a portion of the resin having the spring function (which is opposed to the slit). The trouble occurs particularly when the photosensitive drum is left in a high-temperature environment. Due to its creep property, the resin tends to become deformed over time regardless of the magnitude of the stress applied. In addition, as the environmental temperature increases, the resin and cylinder are expanded to thereby increase the stress level, and the resin itself becomes more likely to be deformed due to heat. In case a temperature returns to a room-temperature level after the cylindrical member has experienced the high-temperature environment, the pressure contact force decreases substantially as compared to the initial value, thereby reducing the member's sound reduction effect. Depending on the thermal conditions to which the cylindrical member is exposed and the duration, the pressure contact force may become zero to thereby prevent proper fixation. In this case, the member's muffling function is no longer provided. Such a high-temperature environment is assumed to exist during transportation or practical use of an image-forming apparatus.

The present invention has been made in view of these problems, and an object of the invention is to provide an electrophotographic photosensitive member comprising a cylindrical resin member fixed to a photosensitive drum to provide a pressure contact therewith, the photosensitive drum being subjected to the contact-charging method and having a charging-sound absorption capability, wherein the cylindrical resin member is not adversely affected when it is left in an adverse operating environment.

SUMMARY OF THE INVENTION

To attain the above object, the present invention provides an electrophotographic photosensitive member, wherein a cylindrical resin member having a metallic spring built therein is fixed to a photosensitive drum by means of a pressure contact force applied to the drum's inner surface.

DETAILED DESCRIPTION OF PREFERRED EMBODIMENTS

Figure 1:
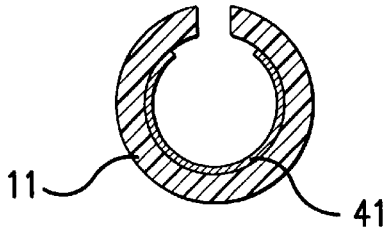
FIG. 1 is a sectional view of a cylindrical resin member according to a first embodiment of the present invention.
Figure 2:
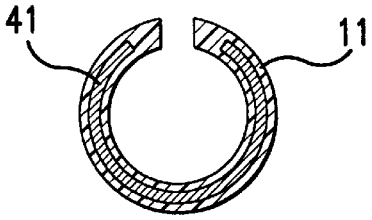
FIG. 2 is a sectional view of a cylindrical resin member according to a second embodiment of the present invention.
Figure 3:
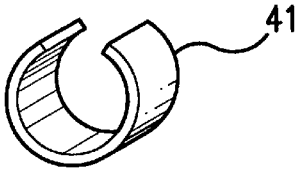
FIG. 3 is a perspective view of a metallic spring according to the first embodiment of the present invention.

FIG. 1 is a sectional view of a cylindrical resin member according to a first embodiment of the present invention. FIG. 2 is a sectional view of a cylindrical resin member according to a second embodiment of the present invention. FIG. 3. is a perspective view of a metallic spring according to the first embodiment of the present invention.

In FIG. 1, a cylindrical resin member 11 preferably has a slit at one location so as to extend in an axial direction thereof, and has a C-shaped cross section perpendicularly to the axial direction. A metallic spring 41, which is shown in FIG. 3, is fixed to an inner surface of the cylindrical resin member 11 so as to widen the slit in the cylindrical resin member 11.

In FIG. 2, the metallic spring 41 shown in FIG. 3 is embedded in the cylindrical resin member 11 so as to widen the slit in the cylindrical resin member 11.

In addition to the C-shaped plate spring having a C-shaped cross section extending perpendicularly to the axial direction as in the cylindrical resin member 11 shown in FIG. 3, the metallic spring 41 may be a C-shaped wire spring.

FIGS. 4(*a*) and 4(*b*) show cylindrical resin members used for comparative experiments. FIG. 4(*a*) is a sectional view of a cylindrical resin member formed only of a resin, and FIG. 4(*b*) is a sectional view of a cylindrical resin member with a metallic spring fixed inside. A cylindrical resin member 11 was comprised of polypropylene and a metallic spring 41 was comprised of a stainless plate spring having a plate thickness of 0.5 mm. FIGS. 5(*a*)–5(*c*) show photosensitive members used for the comparative experiments. FIGS. 5(*a*) and 5(*b*) are sectional views of the photosensitive members produced by inserting the cylindrical resin members shown in FIGS. 4(*a*) and 4(*b*), respectively, into the corresponding photosensitive members. FIG. 5(*c*) is a sectional view of the photosensitive member with no cylindrical resin member inserted therein. A photosensitive member 61 was comprised of an aluminum pipe (inner diameter of 28.5 mm) having its surface coated with an organic photosensitive layer. These photosensitive members were identical except for the cylindrical resin member and were prepared at normal temperature (25° C.) and humidity (50% RH).

Experiments on charging noise were conducted as follows:

An image forming apparatus using the roller charging method and a noise measuring instrument were installed in an anechoic room at fixed positions spaced by about 50 cm. The anechoic room was maintained at normal temperature (25° C.) and humidity (50% RH). Prior to an actual charging-sound measurement, the voltage to be applied to a charging roller inside the image forming apparatus was turned off, while the apparatus was allowed to remain operating to measure noise n (dB) in a condition that no charging sound occurs. Next, the voltage was applied to the roller, and the photosensitive members shown in FIGS. 5(*a*) to 5(*c*), respectively, were incorporated in the image forming apparatus. Then, corresponding noises a to c (dB) were measured during operation. Charging sound Δ (dB) was defined as a numerical value obtained by subtracting noise n (dB) from each of the noises a to c (dB). Table 1 shows the results of the measurements of the charging sound. In the actual auditory system, no operational problem occurs when, the charging sound Δ (dB) is 4 dB or less.

TABLE 1

| photosensitive member | Δ(dB): Normal temperature |
|---|---|
| FIG. 5(a) | 2 dB |
| FIG. 5(b) | 2 dB |
| FIG. 5(c) | 8 dB |

Low-temperature environment experiments were conducted as follows:

The photosensitive members shown in FIGS. 5(*a*) to 5(*c*) were placed in an environment apparatus with the temperature set equal to −20° C. and the humidity set equal to 20% RH. The photosensitive members were then left as they were for 24 hours. Subsequently, the photosensitive members were left at normal temperature (25° C.) and humidity (50% RH) for 1 hour, and the charging sound was measured again. The results are shown in Table 2. When the photosensitive members were left at the low temperature, the photosensitive members maintained their muffling-effect function irrespective of the presence of the metallic spring 41.

TABLE 2

| Photosensitive member | Δ(dB): Normal temperature | Δ(dB): After being left at low temperature |
|---|---|---|
| FIG. 5(a) | 2 dB | 2 dB |
| FIG. 5(b) | 2 dB | 2 dB |
| FIG. 5(c) | 8 dB | 8 dB |

High-temperature environment experiments were conducted as follows:

The photosensitive members shown in FIGS. 5(*a*) to 5(*c*) were placed in an environment apparatus with the temperature set equal to 50° C. and the humidity set equal to 40% RH. The photosensitive members were then left as they were for 24 hours. Subsequently, the photosensitive members were left at normal temperature (25° C.) and humidity (50% RH) for 1 hour, and the charging sound was measured again. The results are shown in Table 3. When the photosensitive members were left at the high temperature, the photosensitive member shown in FIG. 5(*a*) lost its muffling-effect function.

TABLE 3

| Photosensitive member | Δ(dB): Normal temperature | Δ(dB): After being left at low temperature |
|---|---|---|
| FIG. 5(a) | 2 dB | 7 dB |
| FIG. 5(b) | 2 dB | 2 dB |
| FIG. 5(c) | 8 dB | 8 dB |

Table 4 shows the dimension d (FIG. 4) of the cylindrical resin member 11 measured before and after the environmental experiments.

TABLE 4

Figure 4A:
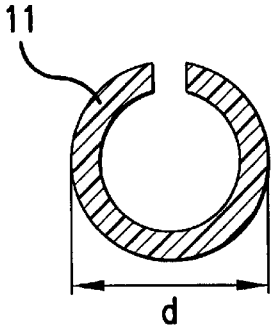
FIGS. 4(*a*) and 4(*b*) show cylindrical resin members used for comparative experiments, wherein FIG. 4(*a*) is a sectional view of a cylindrical resin member formed only of a resin, and FIG. 4(*b*) is a sectional view of a cylindrical resin member with a metallic spring fixed inside.
Figure 4B:
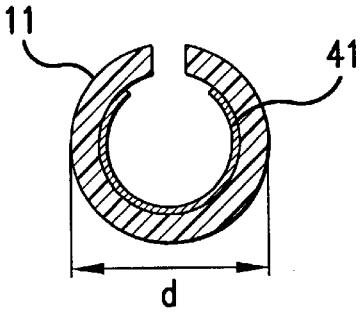
Figure 5A:
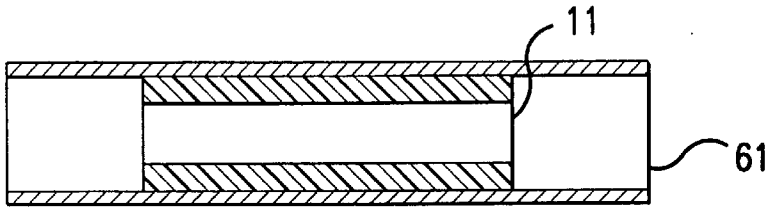
FIGS. 5(*a*)–5(*c*) show photosensitive members used for the comparative experiments, wherein FIGS. 5(*a*) and 5(*b*) are sectional views of the photosensitive members produced by inserting the cylindrical resin members shown in FIGS. 4(*a*) and 4(*b*), respectively, into the corresponding photosensitive members, and FIG. 5(*c*) is a sectional view of the photosensitive member with no cylindrical resin member.
Figure 5B:
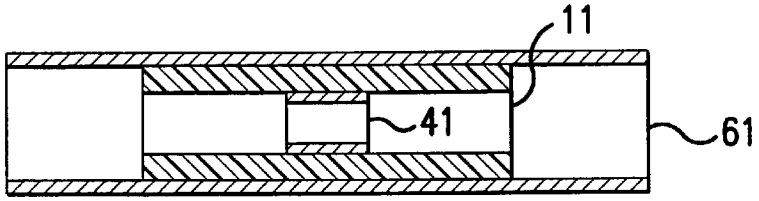
Figure 5C:
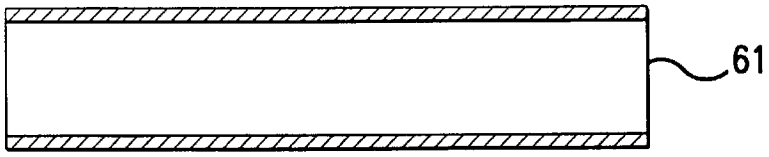
Figure 6:
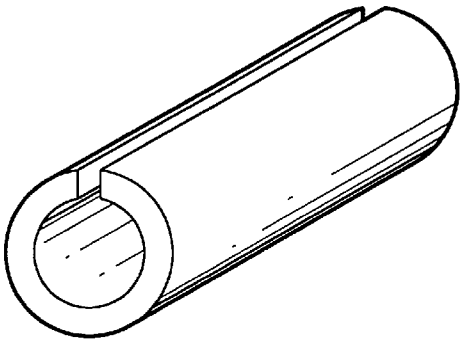
FIG.6 PRIOR ART
FIG. 6 is a perspective view of a conventional cylindrical resin member.

| Cylindrical resin member | Dimension d(1) | Dimension d(2) | Dimension d(3) |
|---|---|---|---|
| FIG. 4(a) | 28.7 mm | 28.7 mm | 28.4 mm |
| FIG. 4(b) | 28.7 mm | 28.7 mm | 28.7 mm |

Dimension d(1) is measured before the experiments.

Dimension d(2) is measured after being left in the low-temperature environment.

Dimension d(3) is measured after being left in the high-temperature environment.

As the table indicates, the dimension d of the cylindrical resin member 11 shown in FIG. 4(*a*) decreased below the inner diameter of the aluminum pipe after the cylindrical member was left at high temperature. Thus, when the cylindrical resin member was left in the high-temperature environment, this cylindrical resin member was presumably deformed, so that its pressure contact force on the photosensitive member was reduced and the muffling-effect function was lost.

On the other hand, the photosensitive member shown in FIG. 5(*b*) maintained its muffling-effect function. Since the dimension d of the cylindrical resin member 11 shown in FIG. 4(*b*) remained at 28.7 mm even after the cylindrical member was left at high temperature, the inside metallic spring 41 is assumed to restrain deformation of the resin, thus maintaining the pressure contact force required to preserve the muffling-effect function.

The present invention can provide an electrophotographic photosensitive member that can maintain a muffling-effect function even in a high-temperature environment and is thus reliable in terms of its ability to suppress charging-related sound.

While the invention has been explained with reference to the specific embodiments of the invention, the explanation is illustrative and the invention is limited only by the appended claims.

What is claimed is:

1. An electrophotographic photosensitive member comprising:

a photosensitive drum, and a cylindrical resin member having a metallic spring therein, said cylindrical resin member being situated inside the photosensitive drum to provide a pressure to an inner surface of the drum and having a slit extending along an axial direction thereof to have resiliency in radial directions thereof, said metallic spring having a C-shape in section with a slit to have resiliency in radial directions thereof so that the metallic spring is disposed inside the cylindrical resin member to allow the slits of the cylindrical resin member and the metallic spring align together, said metallic spring being embedded inside the cylindrical resin member.

2. An electrophotographic photosensitive member comprising:

a photosensitive drum, and a cylindrical resin member having a metallic spring therein, said cylindrical resin member being situated inside the photosensitive drum to provide a pressure to an inner surface of the drum and having a slit extending along an axial direction thereof to have resiliency in radial directions thereof, said metallic spring having a C-shape in section with a slit to have resiliency in radial directions thereof so that the metallic spring is disposed inside the cylindrical resin member to allow the slits of the cylindrical resin member and the metallic spring align together, said metallic spring being formed of a plate spring having a width extending in an axial direction thereof, said width of the metallic spring being smaller than a width of the cylindrical resin member, which is less than a width of the photosensitive drum, said cylindrical resin member being fixed to the photosensitive drum with a pressure contact force by the metallic spring to provide a charging-sound absorption capability thereto.

3. An electrophotographic photosensitive member according to claim 2, wherein said metallic spring is situated in a center of the cylindrical resin member in the axial direction thereof, which is also situated in a center of the photosensitive drum in an axial direction thereof.

* * * * *